United States Patent [19]

Wood et al.

[11] Patent Number: 4,874,573

[45] Date of Patent: Oct. 17, 1989

[54] LID ARRANGEMENT

[75] Inventors: Ian A. Wood, Rothley; Edward A. Horsfield, Cheltenham, both of England

[73] Assignee: The English Electric Company Limited, England

[21] Appl. No.: 171,689

[22] Filed: Mar. 22, 1988

[30] Foreign Application Priority Data

Apr. 3, 1987 [GB] United Kingdom ..... 8707972
Jan. 15, 1988 [GB] United Kingdom ..... 8800887

[51] Int. Cl.[4] ..... G21F 5/00

[52] U.S. Cl. ..... 376/272; 250/506.1; 220/256; 220/319; 220/327

[58] Field of Search ..... 376/272, 287, 203; 250/506.1, 507.1; 220/256, 319, 327

[56] References Cited

U.S. PATENT DOCUMENTS

| | | | |
|---|---|---|---|
| 2,919,048 | 12/1959 | Harvey | 220/256 |
| 2,920,789 | 1/1960 | Tinker | 220/256 |
| 4,055,274 | 10/1977 | Waldenmeier et al. | 220/256 |
| 4,159,063 | 6/1979 | Weber et al. | 220/256 |
| 4,260,312 | 4/1981 | Hackney | 250/506.1 |
| 4,282,441 | 8/1981 | Filoramo | 250/515 |
| 4,302,680 | 11/1981 | Ahner et al. | 250/506.1 |
| 4,437,578 | 3/1984 | Bienek et al. | 220/256 |
| 4,495,139 | 1/1985 | Janberg et al. | 376/272 |
| 4,582,668 | 4/1986 | Mallory et al. | 376/272 |
| 4,589,564 | 5/1986 | Olster et al. | 220/3 |
| 4,643,328 | 2/1987 | Lorenzelli et al. | 220/256 |
| 4,665,668 | 5/1987 | Serpico | 220/256 |

FOREIGN PATENT DOCUMENTS

| | | |
|---|---|---|
| 1141871 | 2/1969 | United Kingdom . |
| 1154215 | 6/1969 | United Kingdom . |
| 1196269 | 6/1970 | United Kingdom . |
| 1324015 | 7/1973 | United Kingdom . |
| 2042403 | 9/1980 | United Kingdom . |

*Primary Examiner*—Brooks H. Hunt
*Assistant Examiner*—Daniel Wasil
*Attorney, Agent, or Firm*—Kirschstein, Ottinger, Israel & Schiffmiller

[57] ABSTRACT

A double lid arrangement, suitable for use in sealing irradiated fuel transport flasks, has inner and outer lids held together by securing members. If the securing members fail, the inner and outer lids operate individually, ensuring that the flask remains sealed.

13 Claims, 3 Drawing Sheets

LID ARRANGEMENT

BACKGROUND OF THE INVENTION

This invention relates to a lid arrangement adapted to seal a vessel against the release of its contents and, more especially, a lid arrangement suitable for use in sealing irradiated fuel transport flasks.

SUMMARY OF THE INVENTION

It is an object of this invention to provide a lid arrangement which remains sealed during certain adverse conditions as will be apparent from the following description.

According to the invention, a lid arrangement for a vessel comprises an inner lid member and an outer lid member adapted to be held together by a securing means such that if the securing means fails, said inner and outer lid members will operate individually to maintain the vessel closed and sealed.

More specifically there is provided, in accordance with the invention, a lid arrangement for a vessel comprising a deformable inner lid member, an outer lid member and means for securing the members together to form a single unit arranged to be fitted to an opening in the vessel with the inner lid member secured to the vessel so as to seal said opening, the means securing the members together being arranged to fail on the occurrence of fault conditions which result in a deformation of the inner lid member, and the outer lid member being associated with stop means arranged to restrict its movement relative to the vessel so as to limit the degree of deformation of the inner lid member and prevent failure of the seal.

Conveniently the inner lid member comprises a central flexible membrane surrounded by a peripheral rim which is arranged to be sealed to a cooperating surface of the vessel. In the case of a lid arrangement for a nuclear fuel transport flask the outer lid member preferably provides nuclear radiation shielding and is such that when urged against the stop means on failure of the securing means shielding integrity is maintained. The stop means may be provided by a plurality of chocks spaced around the vessel and each engaging a recess in the inner wall of the vessel.

Preferably the securing means consists of at least one screw which fixes a rim of the inner lid member to the outer lid member. The rim of the inner lid member is suitably bolted down against a seal face of the vessel. Conveniently each of the bolts is fitted with an extension piece to allow operation through the outer lid member. The extension should be loose to ensure, firstly, that its inertia has no effect in an impact and also that any side movement of the outer lid member does not lead to bending stresses in the bolt. A bayonet fitting may be used to retain the bolts in the outer lid member.

Seals are conveniently fitted around the rim of the inner lid member and around each bolt position.

BRIEF DESCRIPTION OF THE DRAWINGS

A lid arrangement in accordance with the invention will now be described, by way of example, with reference to FIGS. 1 to 5 of the accompanying schematic drawings wherein.

DETAILED DESCRIPTION OF THE PREFERRED EMBODIMENTS

Figure 1:
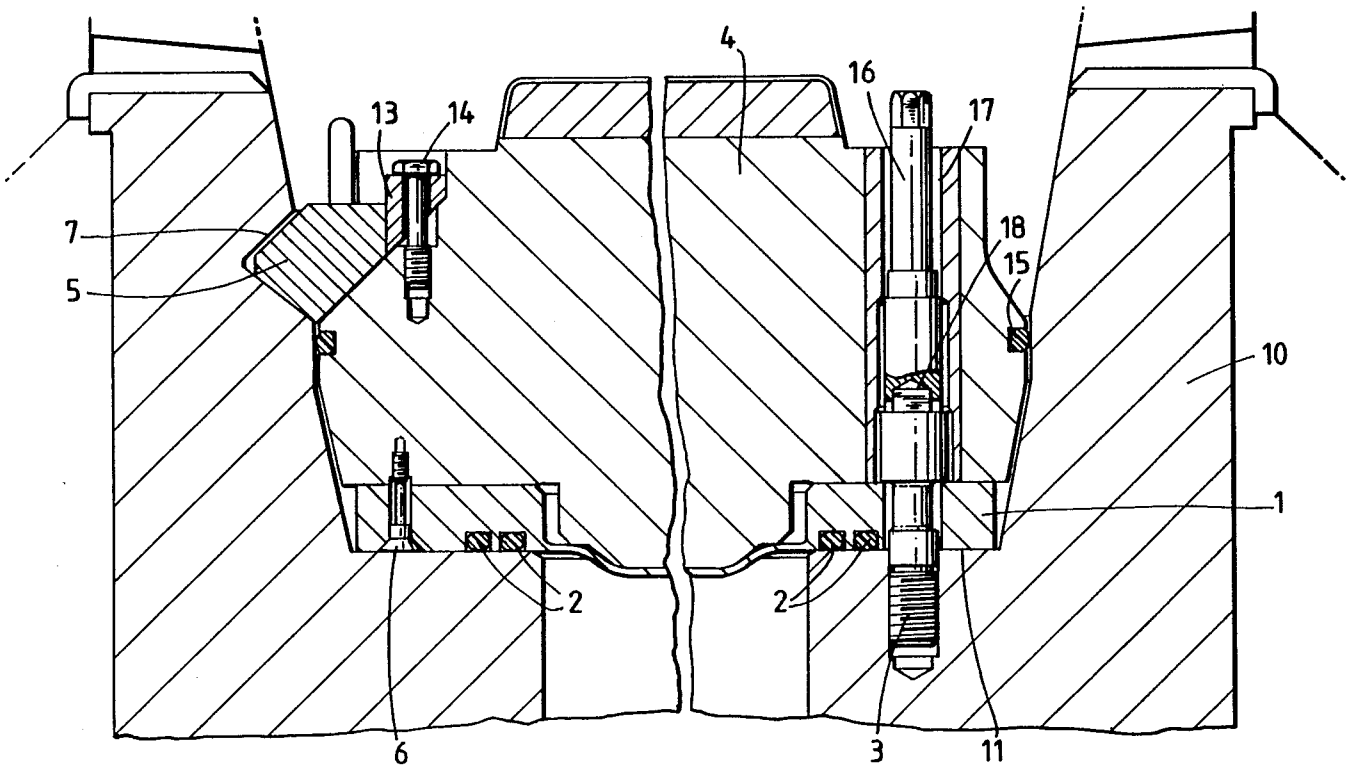
FIG. 1 shows a sectional view of the lid arrangement.

FIG. 1 shows the lid arrangement closing the upper end of a flask 10 (shown only in part) for transporting irradiated nuclear fuel, the lid arrangement being in the form of a double lid comprising an inner lid 1 and a relatively thicker outer lid 4 which acts as a nuclear radiation shield. Grooves on the underside of the peripheral rim of the inner lid 1 house O-ring seals 2, the central portion of the lid 1 being a flexible membrane. Bolts 3 passing through the peripheral rim of the lid 1 secure it in position within a well formed at the top of the flask 10 with the O-ring seals 2 held in contact with an internal shoulder 11 of the flask. Loose extension pieces 16 are coupled to the bolts 3 and extend upwards through opening 17 in the outer radiation-shielding lid 4 to enable the bolts to be readily manipulated. The radiation shielding lid 4 fits over the inner lid 1 and, in normal use, the inner lid 1 and the outer lid 4 are held together by small screws 6 and operate as a single double lid unit. The inner surface of the well at the top of the flask 10 is provided with a series of recesses 7 of triangular section spaced uniformly around it, and when the lid unit is in position closing the flask, chocks 5 are fitted into these recesses and are held in position by means of wedges 13 secured to an inclined shoulder around the periphery of the outer lid 4 by means of studs 14. A further O-ring seal 15 is accommodated within an annular groove around the outer lid and forms a seal against the inner surface of the well.

Figure 2:
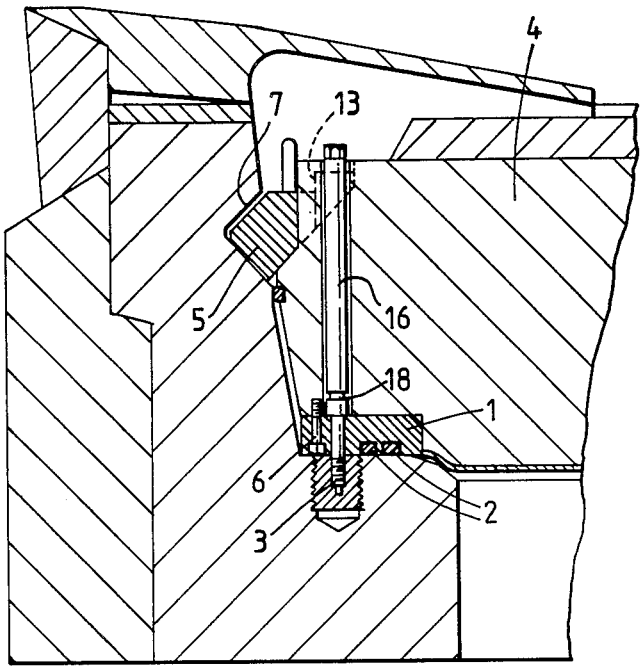
FIG. 2 shows a sectional view of part of the lid arrangement under normal pressure.
Figure 3:
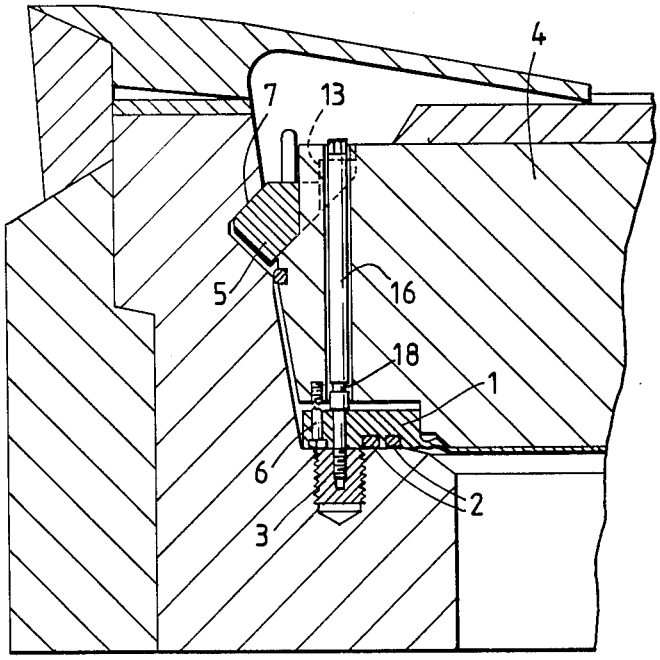
FIG. 3 shows the arrangement under high internal pressure.

FIG. 2 shows in diagrammatic form a section of one side of the lid arrangement under normal conditions illustrating one of the series of securing bolts 3 which are spaced around the lid arrangement, the bolts passing freely through openings in the outer lid 4. Under high internal pressure (FIG. 3) the small fixing screws 6 fail, and the pressure against the membrane forces the lid 4 up against the chocks 5. The chocks then engage the upper surface of the recesses 7 in the vessel wall. Most of the internal pressure is transferred to the vessel wall via the chocks 5 with only a small proportion being transferred to the inner lid as the central membrane section is reacted directly onto the outer lid.

Figure 4:
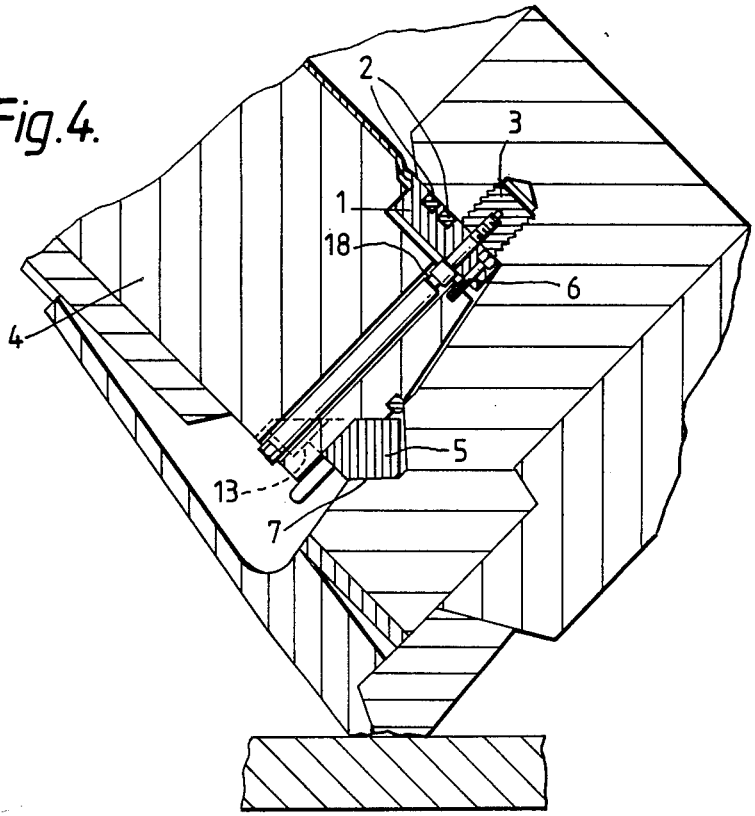
FIG. 4 shows the arrangement under impact conditions.

High internal pressure can also be generated by an impact resulting in stress of the central membrane of the inner lid 1. It is important to reduce this stress which could lead to overstressing of the fixing bolt 3. Additional stress is caused in the membrane by the movement of the outer lid which causes the edge of the lid to roll against the membrane (FIG. 4). The membrane of the inner lid 4 is specially shaped so as to allow significant movement of the outer lid 4.

Thus when the contents of the vessel expand, the two parts of the lid separate to allow the outer lid to rise whilst the seals of the vessel remain intact.

Figure 5:
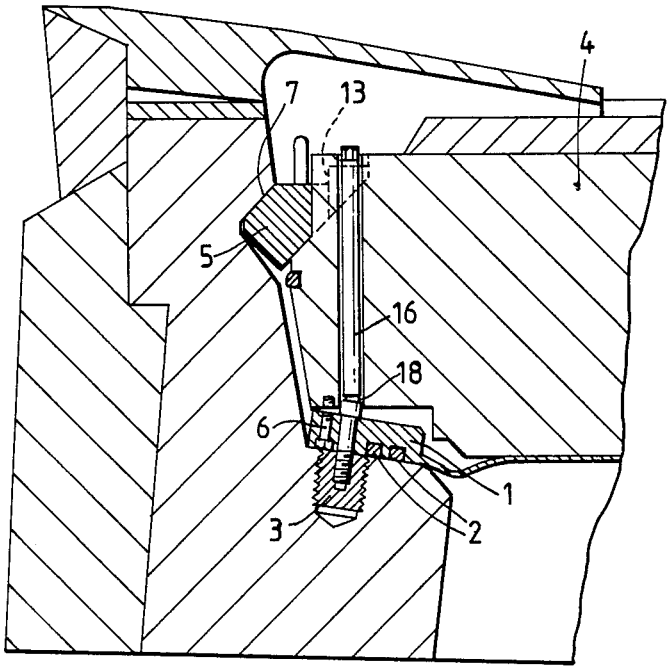
FIG. 5 shows the arrangement under thermal distortion.

Thermal distortion results from a temperature gradient which is set up through the vessel wall causing bowing and distortion which results in the seal face bending inwards toward the centre of the vessel sides as shown in FIG. 5. Because the seals are held in close contact and the inner member 1 is flexible, this distortion does not lead to a gap opening as would occur with a conventional lid. Such distortion is accommodated at the junction 18 between the bolts 3 and extension pieces 16, thus avoiding any strain being placed on the bolts 3 themselves, thereby ensuring that the seals between the inner part of the lid and the vessel remain intact.

We claim:

1. A lid assembly to be secured in an opening in a vessel to seal said opening, said lid assembly comprising:

(a) a deformable inner lid member;

(b) an outer lid member;

(c) means for securing said inner and outer lid members together to form a single unit which is to be inserted, inner lid member first, into said opening;

(d) means for attaching said inner lid member to said vessel so that, in use, said inner lid member seals said opening;

(e) stop means associated with said outer lid member;

(f) said securing means being operative for releasing said outer lid member from said inner lid member on the occurrence of a fault condition which results in deformation of said inner lid member, thereby allowing said outer lid member to move relative to said vessel; and (g) said stop means then being operative for restricting the extent of movement of said outer lid member relative to said vessel so as to limit the degree of deformation of said inner lid member and prevent leakage of the seal.

2. A lid assembly according to claim 1, wherein said outer lid member provides nuclear radiation shielding.

3. A lid assembly as claimed in claim 1, wherein said inner lid member comprises a central flexible membrane encircled by a peripheral rim which, in use, makes sealing contact with said vessel.

4. A container comprising, in combination:

(A) a vessel having an opening; and (B) a lid assembly to be secured in said opening to seal said opening, said lid assembly including (i) a deformable inner lid member, (ii) an outer lid member, (iii) means for securing said inner and outer lid members together to form a single unit which is to be inserted, inner lid member first, into said opening, (iv) means for attaching said inner lid member to said vessel so that, in use, said inner lid member seals said opening, (v) stop means associated with said outer lid member, (vi) said securing means being operative for releasing said outer lid member from said inner lid member on the occurrence of a fault condition which results in deformation of said inner lid member, thereby allowing said outer lid member to move relative to said vessel, and (vii) said stop means then being operative for restricting the extent of movement of said outer lid member relative to said vessel so as to limit the degree of deformation of said inner lid member and prevent leakage of the seal.

5. A container as claimed in claim 4, wherein said inner lid member comprises a central flexible membrane encircled by a peripheral rim which, in use, makes sealing contact with said vessel.

6. A container as claimed in claim 4, wherein said vessel has at least one recess in its wall around said opening; and wherein said stop means comprises a plurality of chocks spaced around said outer lid member, each of which engages in a said recess.

7. A container as claimed in claim 4, wherein at least one seal is fitted around a rim of said inner lid member.

8. A container as claimed in claim 4, wherein said securing means comprises at least one screw which fixes a rim of said inner lid member to said outer lid member.

9. A container as claimed in claim 8, wherein said rim of said inner lid member is fastened against a seal face of said vessel.

10. A container as claimed in claim 9, wherein said rim is fastened by a plurality of bolts.

11. A container as claimed in claim 10, wherein each of said bolts is fitted with an extension piece to allow operation of said bolts through said outer lid member.

12. A container as claimed in claim 10, in which a bayonet fitting is used to retain the bolts in the outer lid member.

13. A container as claimed in claim 10, wherein seals are fitted around each bolt.

* * * * *